US007125188B2

(12) United States Patent
Gueret

(10) Patent No.: US 7,125,188 B2
(45) Date of Patent: Oct. 24, 2006

(54) BRUSH AND DEVICE FOR APPLYING SUBSTANCE TO KERATINOUS FIBERS, AND METHOD AND MACHINE FOR MANUFACTURING BRUSH

(75) Inventor: Jean-Louis H. Gueret, Paris (FR)
(73) Assignee: L'Oreal S.A., Paris (FR)

( * ) Notice: Subject to any disclaimer, the term of this patent is extended or adjusted under 35 U.S.C. 154(b) by 295 days.

(21) Appl. No.: 10/805,317

(22) Filed: Mar. 22, 2004

(65) Prior Publication Data

US 2004/0240926 A1 Dec. 2, 2004

Related U.S. Application Data

(60) Provisional application No. 60/459,602, filed on Apr. 3, 2003.

(30) Foreign Application Priority Data

Mar. 20, 2003 (FR) ..... 03 03448

(51) Int. Cl.
*A46B 11/00* (2006.01)

(52) U.S. Cl. ..... 401/129; 401/122; 401/126; 15/207.2

(58) Field of Classification Search ..... 401/121, 401/122, 126, 129; 15/207.2, 207; 300/4, 300/5, 7, 8
See application file for complete search history.

(56) References Cited

U.S. PATENT DOCUMENTS

| | | | | |
|---|---|---|---|---|
| 4,898,193 | A * | 2/1990 | Gueret | 132/218 |
| 4,927,281 | A * | 5/1990 | Gueret | 401/129 |
| 5,161,554 | A | 11/1992 | Fitjer | |
| 5,657,778 | A | 8/1997 | Gueret | |
| 6,163,918 | A * | 12/2000 | Weihrauch | 15/207.2 |
| 6,241,411 | B1 | 6/2001 | Brieva et al. | |

* cited by examiner

*Primary Examiner*—David J. Walczak
(74) *Attorney, Agent, or Firm*—Finnegan, Henderson, Farabow, Garrett & Dunner, LLP

(57) ABSTRACT

A brush for applying a substance to keratinous fibers may include a twisted core defining turns and bristles extending from the twisted core. The bristles may be clamped between the turns of the twisted core, and the bristles may include at least two deformed bristles clamped between two adjacent turns of the twisted core. Each of the at least two deformed bristles may have a length wherein at at least one point along the length each of the at least two deformed bristles includes either removal of material at the at least one point, stretching of material at the at least one point, or flattening at the at least one point. Each of the at least two deformed bristles may extend outward from the at least one point in a non-radial manner with respect to the twisted core.

47 Claims, 5 Drawing Sheets

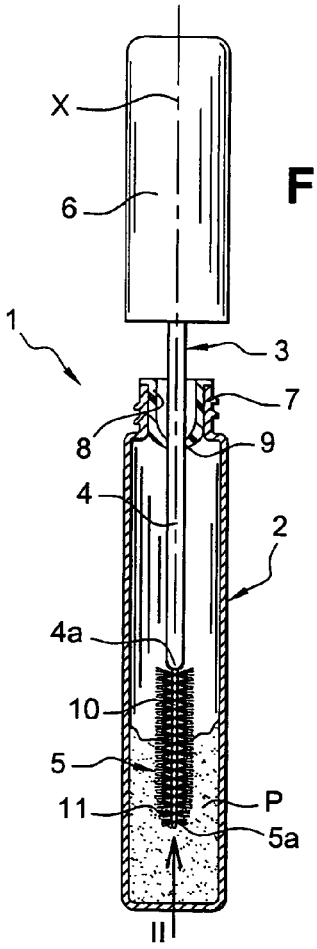
Fig. 1
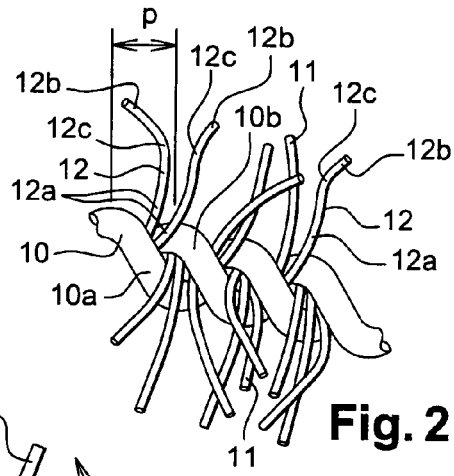
Fig. 2
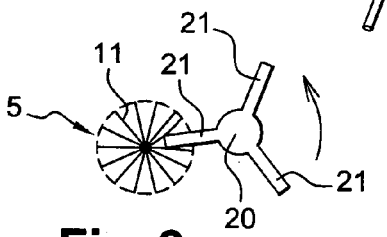
Fig. 3
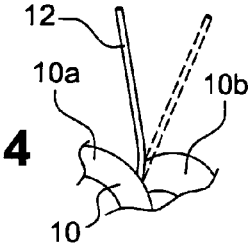
Fig. 4
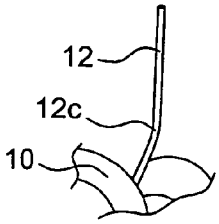
Fig. 5
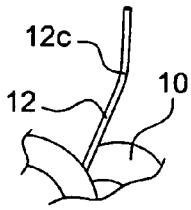
Fig. 6
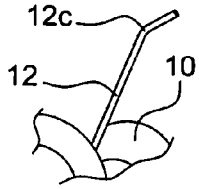
Fig. 7
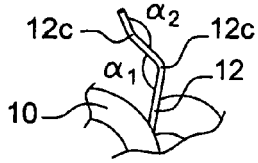
Fig. 8
Fig. 10
Fig. 11
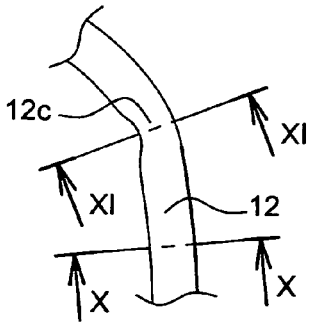
Fig. 9
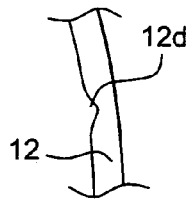
Fig. 12

BRUSH AND DEVICE FOR APPLYING SUBSTANCE TO KERATINOUS FIBERS, AND METHOD AND MACHINE FOR MANUFACTURING BRUSH

This application claims the benefit of priority under 35 U.S.C. § 119(e) of U.S. provisional application No. 60/459,602 filed on Apr. 3, 2003.

The present invention relates to brushes and/or devices for applying a substance to keratinous fibers, for example, the eyelashes and/or the eyebrows. For example, the invention may relate to mascara brushes. The present invention also relates to methods for manufacturing brushes and machines for performing the methods.

In the field of mascara brushes, brushes may include a core formed of two twisted-together metal strands defining turns between which bristles of a mascara brush are held captive. One possible drawback of such mascara brushes may be that they can present a "turn effect" (i.e., ends of the mascara brush bristles may extend in a distribution that is substantially helical.) Such a distribution of bristles may, at least to some extent, impede penetration of eyelashes between bristles of the mascara brush. In some cases, however, it may be desirable to encourage eyelashes to penetrate between the mascara brush bristles so as to be enable them to be loaded with a relatively large quantity of substance, and further, so as to enable them to spread the substance on the eyelashes and lengthen and/or curl them.

One known process imparts mechanical treatment to bristles of a brush so as to abrade their ends and form forks. For example, U.S. Pat. No. 6,241,411 discloses splitting fibers, which have been formed to include stress weld points such that when the "splittable" fibers are subjected to pressure, they split at the stress points. Such a process may not necessarily result in a stretching of the fibers. Rather, the splitting of fibers having preformed stress weld points may merely dissociate one portion of a fiber from another without any stretching of the initial fiber. Furthermore, such splitting of fibers may be limited to ends of the fibers and/or may not enable distribution of the fibers to be altered.

It is also known to use bristles having special cross-sectional characteristics so that a more uniform distribution of bristles over a surface envelope of the brush may be obtained when the bristles are clamped between the strands of the core. Such a uniform bristle distribution may be present over substantially the entire bristled portion of the brush. In some cases, however, for example, to obtain novel makeup effects, it may be desirable to limit uniform bristle distribution to only certain portions of a brush (e.g., in notches and/or peaks of the bristles). In addition, the use of bristles having special cross-sectional characteristics may limit the materials suitable for use in making the bristles and/or may limit the shapes of bristle that may be used.

There exists a need to obtain a brush having a novel distribution of bristles.

There also exists a need to obtain such a brush without excessively complicating manufacture thereof.

Although the present invention may obviate one or more of the above-mentioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a brush for applying a substance to keratinous fibers. The brush may include a twisted core defining turns and bristles extending from the twisted core. The bristles may be clamped between the turns of the twisted core, and the bristles may include at least two deformed bristles clamped between two adjacent turns of the twisted core. Each of the at least two deformed bristles may have a length wherein at at least one point along the length each of the at least two deformed bristles includes either removal of material at the at least one point, stretching of material at the at least one point, or flattening at the at least one point. Each of the at least two deformed bristles may extend outward from the at least one point in a non-radial manner with respect to the twisted core.

As used herein, the term "flattening" does not mean folding over an unflattened bristle onto itself or unfolding an unflattened bristle, as shown in U.S. Pat. No. 5,657,778.

According to another aspect, at least one of the deformed bristles may include removal of material at the at least one point. In yet another aspect, at least one of the deformed bristles may include stretching of material at the at least one point. In still another aspect, at least one of the deformed bristles may include flattening at the at least one point.

According to yet another aspect, a brush may include a distribution of bristles different from that of some conventional brushes, for example, because of the presence of deformed bristles, while still being capable of being manufactured, for example, using a twisted core and ordinary bristles.

The presence of deformed bristles may render it possible to impart a more uniform distribution to the ends of the bristles by creating a jumble, which may enable the turn effect associated with using a twisted core construction to be substantially attenuated. The brush may also be capable of applying more substance to the eyelashes.

In still a further aspect, each of the at least two deformed bristles may include at least two rectilinear portions joined by at least one bend. The at least two rectilinear portions may, for example, each define a cross-section and each of the cross-sections may be substantially the same. The at least two deformed bristles may each define at least one bend that may be located at substantially the same distance from the twisted core.

In yet another aspect, in brushes including a twisted core, for example, the twisted core may have a left-hand twist (i.e., it may be twisted to the left, and the branches of the core form turns that rise from left to right when the brush is observed in the vertical position with its end fixed in the stem (its proximal end) situated at the bottom, and its free end (its distal end) situated at the top). Alternatively, brushes may include a core having a right-hand twist (i.e., it may be twisted to the right, and the branches of the core form turns that rise from right to left when the brush is observed in the vertical position with its end fixed in the stem (its proximal end) situated at the bottom, and its free end (its distal end) situated at the top).

According to one aspect, at least some of the deformed bristles may include one of removal of material and flattening of material extending only on one side of the deformed bristles.

According to still another aspect, substantially all of the bristles may be deformed bristles. Alternatively, only a portion of the bristles of the brush may be deformed. For example, the portion of the brush having deformed bristles may correspond to a portion extending from one end of the brush over less than half the length of the brush, for example, and/or over particular regions of the brush (e.g., regions defining peaks and/or notches).

According to yet another aspect, at least 5% of the bristles may include deformed bristles. For example, at least 30% of the bristles may include deformed bristles (e.g., at least 70% of the bristles may include deformed bristles). Optionally, substantially all of the bristles may be deformed bristles.

In still another aspect, the brush may include from about five bristles per turn of the twisted core to about 80 bristles per turn of the twisted core. For example, the brush may include from about ten bristles per turn of the twisted core to about 50 bristles per turn of the twisted core. The number of bristles per turn may substantially correspond to the number of bristle ends countable by a stationary observer, for example, when the brush is revolved through about 180° about its core. According to another aspect, when the brush is viewed in a direction of observation perpendicular to a longitudinal axis of the brush, the brush may include at least two bristles that cross each other.

In yet a further aspect, at least some of the bristles may include bristles formed from a synthetic material (e.g., a thermoplastic material). According to another aspect, at least some of the bristles may include bristles formed from a natural material.

According to still another aspect, the bristles may be stretchable.

In a further aspect, at least some bristles may have a substantially solid cross-section and/or may define a substantially circular cross-section. According to another aspect, the bristles may include at least one hollow bristle. In yet a further aspect, the bristles may include at least one bristle coated in flocking. In still another aspect, the bristles may include at least one bristle including at least one capillary groove (e.g., a bristle defining a cross-section that is kidney-shaped). In another aspect, the bristles may include at least one bristle defining a substantially non-circular cross-section.

According to another aspect, the bristles may include a filler (e.g., a compound exhibiting at least one of magnetic properties, bacteriostatic properties, and moisture-absorbing properties, and/or a compound for creating roughness on the surface of a bristle and/or for encouraging bristles to slide over the eyelashes).

In still another aspect, at least some of the bristles may have a diameter ranging from about 5/100 millimeter to about 40/100 millimeter. For bristles not defining a substantially circular cross-section, the term "diameter" may be used to designate the diameter of a circle that circumscribes the largest cross-section of the substantially non-circular bristle.

According to a further aspect, the length of the bristles from the core to their free ends may, for example, ranges from about 1 millimeter to about 7 millimeters (e.g., from about 2 millimeters to about 5 millimeters). For example, the brush may include a mixture of bristles having differing lengths and/or having differing characteristics (e.g., the bristles may include a mixture of different types of bristles). For example, when the brush includes a mixture of bristles having differing lengths, deformation of bristles may be imparted only to those bristles that have a certain length.

In still another aspect, at least one of the deformed bristles may include at least one deformed section at one point along its length and another deformed section at another point along its length. For example, a bend may be located at each deformed section of the at least one deformed bristle, and each bend may define a differing angle.

According to another aspect, an envelope surface of the brush may define a variety of shapes. For example, the envelope surface may define a cross-section that is at least one of circular, oval, polygonal, etc., and may include one or more notches and/or indentations. According to still another aspect, the core may be centered in a cross-section of the envelope surface. In another aspect, the core may not be centered in a cross-section of the envelope surface.

According to yet a further aspect, the brush may include at least one peak and/or at least one notch. For example, the majority of deformed bristles of the brush (e.g., substantially all of the deformed bristles) may be bristles that define at least one peak and/or at least one notch.

In yet another aspect, the cross-section of the envelope surface may be, for example, substantially constant or non-constant over at least a fraction of the length of the brush, and, for example, the brush may define a cross-section that passes through an extremum between its two axial ends. The extremum may be either a maximum or a minimum. The brush may thus define, for example in side view, generally an hourglass shape or an American football shape.

According to another aspect, the core may be substantially rectilinear or non-rectilinear (e.g., the core may be curved with curvature distributed along substantially its entire length or the core may be curved in a localized region in the vicinity of a region where the core is fixed to an applicator stem). According to some aspects, the brush may be curved about at least two axes that are not coplanar.

In still a further aspect, a device for application of a substance to one of eyelashes and eyebrows, may include a brush and a receptacle containing the substance to be applied. According to another aspect, the substance may include mascara. In still a further aspect, the receptacle may be associated with a wiper member (e.g., for wiping the brush as it leaves the receptacle).

In yet a further aspect, a brush for applying a substance to keratinous fibers may include bristles extending from a core. The brush may include at least some bristles that have been subjected to deformation at at least one point along their length. The deformation may be restricted to substantially only one side of each deformed bristle (e.g., the deformation does not extend around substantially the entire circumference of the deformed bristle).

According to still another aspect, a method of manufacturing a brush for applying a substance to keratinous fibers may include providing an initial brush including a twisted core defining turns and bristles extending from the twisted core. The bristles may be clamped between the turns of the twisted core. The method may further include relatively displacing at least one treatment member and the bristles of the initial brush with respect to one another such that the at least one treatment member strikes at least some of the bristles and changes, in a substantially permanent manner, the orientations of at least a portion of at least some of the bristles so as to form at least two deformed bristles clamped between two adjacent turns of the twisted core. Each of the at least two deformed bristles having a length, wherein at at least one point along the length each of the at least two deformed bristles includes either removal of material at the at least one point, stretching of material at the at least one point, or flattening at the at least one point. Each of the at least two deformed bristles may extend outward from the at least one point in a non-radial manner with respect to the twisted core.

The term "providing" is used in a broad sense, and refers to, but is not limited to, making available for use, enabling usage, giving, supplying, obtaining, getting a hold of, acquiring, purchasing, manufacturing, selling, distributing, possessing, making ready for use, and/or placing in a position ready for use.

In still another aspect, the treatment member may be at ambient temperature (e.g., so as to mechanically deform the bristles while cold).

In yet a further aspect, the deformed bristles may include traces of matter being removed and/or of flattening.

According to another aspect, the treating at least some of the bristles may serve to destructure the brush, for example, by modifying the orientations of the bristles (e.g., by attenuating the turn effect that may be exhibited by an initial, untreated brush, which may include a helical distribution of the free ends of its bristles). For example, prior to contact with the at least one treatment member, the initial brush may include bristles each having a free end, wherein the free ends follow a substantially helical distribution, and wherein, after contacting of the at least one treatment member with the bristles, the free ends do not present a substantially helical distribution.

In still a further aspect, the deformed bristles may also exhibit greater flexibility and/or greater damping effect, for example, since the bristles may bend more easily once they have been contacted with the treatment member at at least one point along their length, thereby possibly creating a type of hinge. This may render it possible, for example, to use bristles that are thicker and/or more rigid.

In yet another aspect, the bristles that are treated may substantially lose their radial orientation and may take up an orientation that is non-radial (e.g., that is oblique relative to the longitudinal axis of the core of the brush), which may, for example, facilitate penetration of the eyelashes between the bristles of the brush.

According to a further aspect, the method may enable a brush to be made that initially presents relatively large spacing between tufts of bristles that are clamped between the turns of a twisted core (e.g., when the brush includes a twisted core) since the spacing between the ends of the bristles may be reduced following the method because the orientations of the bristles may have been modified.

In another aspect, the initial brush may be of one of many types. For example, the brush may or may not include a twisted core. For example, the bristles may be fixed to a core via stapling and/or by stamping, and/or the core may be overmolded onto the bristles.

According to another aspect, relatively displacing may include at least rotating the initial brush about its axis. In a further aspect, relatively displacing may include at least rotating the treatment member. In still a further aspect, relatively displacing may include rotating the treatment member and the brush.

In another aspect, the treatment member may include a surface that is suitable for contacting the bristles of the brush (e.g., the treatment member may extend over a length greater than or equal to about half the length of the portion of the brush having bristles).

In yet another aspect, relatively displacing and relative positions of the brush and the at least one treatment member are selected such that the at least one treatment member contacts only a portion of the bristles during the method.

In still a further aspect, the method may cause bends to be formed in at least a portion of the bristles. For example, the method may form bends in at least a portion of the bristles, and the bends may be spaced from the twisted core by a predefined distance. For example, at least a portion of the bristles may be treated at a point that is closer to the core than to the free ends of the bristles.

According to another aspect, only a portion of the circumference of a brush may be treated. For example, the initial brush may define a circumference and may include bristles having differing lengths defining at least two regions of the circumference, wherein only a region defined by longer bristles is contacted with the at least one treatment member.

In another aspect, prior to contact with the at least one treatment member, the initial brush may include an envelope surface defining a cross-section that is substantially non-circular over at least a portion of the length of the envelope surface. The brush may have at least two regions of its circumference defined by bristles of different lengths, and the region having the longer bristles may be treated without treating the region having the shorter bristles.

In still a further aspect, the initial brush may include bristles extending substantially around the twisted core and defining a circumference, and wherein only a portion of the bristles defining the circumference is contacted with the at least one treatment member.

According to another aspect, at least some bristles may include bends that may be located a distance from the core that is greater than the length of shorter bristles (e.g., when the brush includes bristles having differing lengths).

In still a further aspect, a surface state of the treatment member may be selected as a function of the treatment that it is desired to be performed. For example, the treatment member surface may be smooth or slightly non-smooth (e.g., rough). The surface state may be selected in such a manner so as to substantially avoid cutting through the bristles (e.g., the treatment member may substantially lack any sharp edges).

According to yet another aspect, prior to treatment, at least some bristles of the brush may define a section that is substantially constant (e.g., a circular cross-section and/or a kidney-shaped cross-section). According to another aspect, each bristle may include at least one capillary groove.

In still another aspect, a treated brush may include a twisted core, and may include from about five bristles per turn to about 80 bristles per turn (e.g., from about ten bristles per turn to about 50 bristles per turn).

According to another aspect, prior to treatment, the brush may exhibit a turn effect, and after treatment, the brush may no longer exhibit a turn effect.

In yet another aspect, when the brush is twisted to the left, the relative movement between the bristles of the brush and the treatment member may include the brush turning about its longitudinal axis in, for example, the counterclockwise direction, when the brush is observed along its longitudinal axis from right to left and the stem is situated on the left.

According to still another aspect, the method may include manufacturing the initial brush.

In yet another aspect, a brush for applying a substance to keratinous fibers may be manufactured according to any of the exemplary methods described herein.

According to yet another aspect, a machine for manufacturing a brush for applying a substance to keratinous fibers may include a support configured to support at least one initial brush comprising bristles, a treatment member for treating the at least one initial brush, and means for producing relative displacement between the support and the treatment member so as to strike at least some of the bristles of the initial brush with the at least one treatment member and cause either material to be removed at at least one point along the length of at least some of the bristles, material to be stretched at at least one point along the length of at least some of the bristles, or flattening at at least one point along the length of at least some of the bristles. The orientation of at least a portion of at least some of the bristles may be modified in a substantially permanent manner.

According to some aspects, the machine may enable material to be removed, material to be stretched, or flattening to take place at at least one point along the length of the bristles. For example, the means for producing relative displacement between the support and the treatment member (e.g., a drive means) may include at least one motor enabling the brush to be rotated about its axis and/or enabling the treatment member to be rotated, and where appropriate, enabling the brush and/or the treatment member to be driven in axial displacement. The drive means, for example, may also enable the brush and the treatment member to be moved relative to each other (e.g., toward each other and/or apart from each other). The brush and the treatment member may be rotated simultaneously, in the same direction and/or in opposite directions, about axes that are parallel and/or axes that are not parallel. The relative displacements of the brush and the treatment member may be controlled, for example, by a numerical control device. The treatment member may be rotated at a speed of rotation, for example, ranging from about 1,500 revolutions per minute ("rpm") to about 6,000 rpm.

In still another aspect, a machine for manufacturing a brush for applying a substance to keratinous fibers may include a support arranged to support at least one initial brush including bristles, a treatment member for treating the at least one initial brush, and a motor configured to at least one of rotate the at least one initial brush about its axis, rotate the at least one initial brush other than about its axis, and axially displace at least one of the at least one brush and the treatment member. The motor may cause relative displacement between the support and the treatment member so as to strike at least some of the bristles of the initial brush with the at least one treatment member and cause either material to be removed at at least one point along the length of at least some of the bristles, material to be stretched at at least one point along the length of at least some of the bristles, or flattening at at least one point along the length of at least some of the bristles. The orientation of at least a portion of at least some of the bristles may be modified in a substantially permanent manner.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic, partial cross-section view of one embodiment of a device for applying a product to keratinous fibers;

FIG. 2 is schematic perspective view of a portion of one embodiment of a device;

FIG. 3 is a schematic cross-sectional view of one embodiment of a method of manufacturing a brush;

FIG. 4 is a schematic perspective view of a portion of one embodiment of a device;

FIG. 5 is a schematic perspective view of a portion of a further embodiment of a device;

FIG. 6 is a schematic perspective view of a portion of another embodiment of a device;

FIG. 7 is a schematic perspective view of a portion of a further embodiment of a device;

FIG. 8 is a schematic perspective view of a portion of another embodiment of a device;

FIG. 9 is a schematic perspective view of a portion of one embodiment of a device;

FIG. 10 is a section view along line X—X of FIG. 9;

FIG. 11 is a section view along line XI—XI of FIG. 9;

FIG. 12 is a schematic perspective view of a portion of one embodiment of a device;

Reference will now be made in detail to some possible embodiments of the invention, examples of which are illustrated in the accompanying drawings. Wherever possible, the same reference numbers are used in the drawings and the description to refer to the same or like parts.

Figure 13:
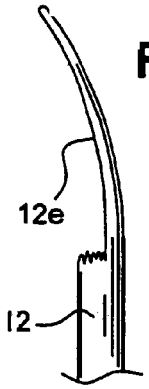
FIG. 13 is a schematic perspective view of a portion of one embodiment of a bristle;.

FIG. 1 depicts an exemplary embodiment of a device 1 for applying a substance to keratinous fibers that may include a receptacle 2 containing a substance P (e.g., mascara) for example, for application to the eyelashes or the eyebrows, and an applicator 3 that may include a stem having a longitudinal axis X. A stem 4 may include at one end 4*a*, a brush 5, and at its opposite end, a handle member 6 that may serve to close the receptacle 2. The receptacle 2 may include a neck 7 having, for example, an outside thread so as to enable the handle member 6 to be screwed thereon.

A wiper member 8 may be mounted on the neck 7, (e.g., fixed inside the neck 7) to wipe the stem and/or the brush 5 as they are being removed from the receptacle 2. The wiper member 8 may include, for example, a flexible lip 9 defining a circular orifice having a diameter substantially equal to that of the stem 4. The invention, however, may not be limited to using a particular wiper member 8, and other wiper members may be used, for example, wiper members that include a block of porous material (e.g., foam) and/or that define one or more slots, which may be, for example, flocked. Alternatively, there might be no wiper member.

In the exemplary embodiment depicted in FIG. 1, the stem 4 is rectilinear. The stem 4, however, may be curved and/or angled. In addition, the stem 4 is depicted in FIG. 1 as being substantially stationary relative to the handle member 6, but it could may alternatively be movable relative to the handle member 6, for example, via a hinged connection (e.g., a ball-and-socket joint).

In the exemplary embodiment depicted in FIG. 1, the brush 5 may include a core 10 formed, for example, by twisting together two strands (e.g., metal strands and/or portions of a single metal wire, wherein the strands are defined by a bend in the wire), and the core 10 may be fixed at one end in a housing in the stem 4 (e.g., by being forcibly inserted into the housing in the stem 4). The brush 5 may carry bristles 11 that are held, for example, by being clamped between twisted strands of the core 10, for example, as depicted in FIG. 2.

According to some exemplary embodiments, the brush 5 may include bristles 12 that are deformed (e.g. having a destructured appearance). A deformed bristle 12, for example, may include two substantially rectilinear portions (e.g., a proximal portion 12*a* connected to the core 10 and a distal portion 12*b*, and the two portions 12*a* and 12*b* may be united, for example, by a bend 12*c*). The bend 12*c* may be due to a deformation of the cross-section of the bristle 12, and the bend 12*c* may act in a hinge-like fashion. The distal portion 12*b* may extend, for example, in random directions. At least two deformed bristles 12 may be held between two adjacent turns 10*a* and 10*b* of the core 10, and may define the pitch p of the core 10, for example, as depicted in the portion of the exemplary embodiment shown in FIG. 2.

In the exemplary embodiment schematically depicted in FIG. 3, in order to manufacture a brush 5 having deformed bristles 12, a treatment member 20 may be arranged to contact (e.g., strike) at least some of the bristles 12 of the brush 5, for example, so as to locally deform their cross-section at at least one point along the length of some of the bristles 12. The treatment member 20, for example, may include at least one blade 21 (e.g., three blades 21, as shown in FIG. 3, and the blade(s) may be in the form of a paddle or paddles), and the blades 21 may be rotated about an axis, which, for example, may be substantially parallel to the longitudinal axis of the brush 5, as shown in FIG. 3. By contacting the bristles 11 of the brush 5, the blades 21 may generate one or more (e.g., at least two) deformed bristles 12.

According to some exemplary embodiments, by selecting the distance between the axis of the brush 5 and the axis of the treatment member 20, the bristles 11 of the brush 5 may be selectively treated in such a manner, for example, that the bends 12*c* may be situated at a predefined distance from the core 10. The bristles 11 may be deformed (e.g., damaged to a greater or lesser extent) so as to obtain either a greater or a smaller number of deformed bristles 12, for example, depending on the speed at which contact between the treatment member 20 and the bristles 11 takes place. In at least some examples, the speed may be slow enough to avoid cutting through substantially all of the bristles 11.

As depicted in the exemplary embodiment shown in FIG. 4, the bristles 11 may be contacted in the vicinity of the core 10, and the orientation of the bristles 11 may be modified so as to cause them to pass from a radial orientation (e.g., as shown in dashed lines in FIG. 4) to a non-radial orientation (e.g., an orientation extending obliquely relative to the longitudinal axis of the core 10 (e.g., extending either at least somewhat toward the proximal end of the brush 5 or at least somewhat toward the distal end of the brush 5)).

In the exemplary embodiments depicted in FIGS. 5 through 7, the bristles 11 of the brush 5 may have been contacted, for example, at respective increasing distances from the core 10. In the exemplary embodiment depicted in FIG. 8, the bristle 12 has been deformed at two locations along its length, thereby forming two bends, which may have, for example, different respective angles $\alpha_1$ and $\alpha_2$.

The action of the treatment member 20 on a bristle may lead to flattening (e.g., a reduced thickness dimension at at least one portion of the bristle 12 as compared to the remainder of the bristle) as shown in FIGS. 9 through 11. In FIG. 10, for example, it can be seen that the bristle can present a section that is circular outside its deformed portion. FIG. 11 shows the creep which the bristle material has undergone in the deformed portion, and that the deformation has occurred essentially on one side only of the bristle (i.e., the side which struck (and/or was struck by) the treatment member 20).

As depicted by the exemplary embodiments shown in FIGS. 12 and 13, contact between the treatment member 20 and the bristle 12 may result in a portion of the material of the bristle 12 being removed. For example, as shown in FIG. 12, material may be removed in the form of a nick 12*d* formed in the bristle 12. Alternatively, or in addition, as shown in FIG. 13, material from the bristle 12 may be removed in such a manner so as to result in a destructuring of the fiber of the bristle 12 (e.g., the bristle 12 may lose a portion 12*e* of its thickness), and the remaining portion of the bristle may be, so to speak, planed thinner over a portion of its length. Alternatively, or in addition, contact between the treatment member 20 and the bristle 12, may, for example, stretch the material of the bristle 12 (e.g., in a substantially permanent fashion), when, for example, the bristles 12 are stretchable.

Figure 14:
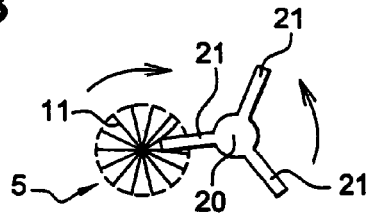
FIG. 14 is a schematic cross-sectional view of one embodiment of a method of manufacturing a brush.
Figure 15:
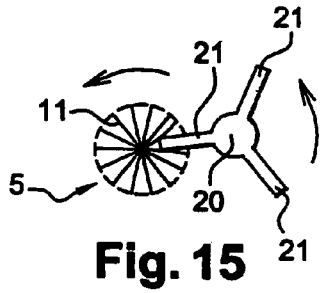
FIG. 15 is a schematic cross-sectional view of another embodiment of a method of manufacturing a brush.

In the exemplary embodiment depicted in FIG. 3, for example, only the treatment member 20 is rotated. According to some exemplary embodiments, however, both the treatment member 20 and the brush 5 may be rotated and contacted with each other, for example, as shown in FIGS. 14 and 15. According to the exemplary embodiment depicted in FIG. 14, the brush 5 and the treatment member 20 may be be contra-rotating, and according to the exemplary embodiment depicted in FIG. 15, the treatment member 20 and the brush 5 may rotate in the same direction.

Figure 16:
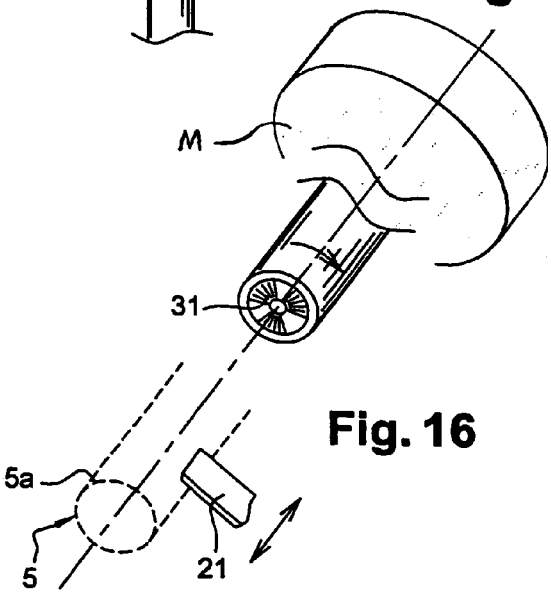
FIG. 16 is schematic perspective view of one embodiment of a method of manufacturing a brush, wherein the figure includes a schematic perspective view of an embodiment of a machine for performing the method.
Figure 17:
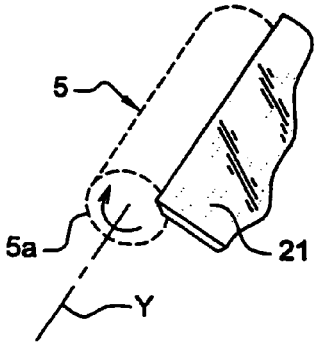
FIG. 17 is schematic perspective view of another embodiment of a method of manufacturing a brush.

According to some exemplary embodiments, the blade(s) 21 may extend over only a fraction of the length of the brush 5, for example, as shown in FIG. 16. For example, the treatment member 20 may be moved in a direction substantially parallel to the brush 5 so as to treat, for example, either substantially the entire length of the bristled-portion of the brush 5, or only a portion of the bristled-portion of the brush 5. FIG. 16 shows, for example, that the brush 5 may be rotated using, for example, a support 31 (e.g., a mandrel), which may clamp onto the core 10 of the brush 5, and which may be driven by a means M for producing relative displacement between the support 31 and the treatment member 20 (e.g., a motor, for example, an electric motor). Alternatively, or in addition, the blade(s) 21 may extend substantially over the entire length of the brush 5, as shown in, for example, FIG. 17.

Figure 18:
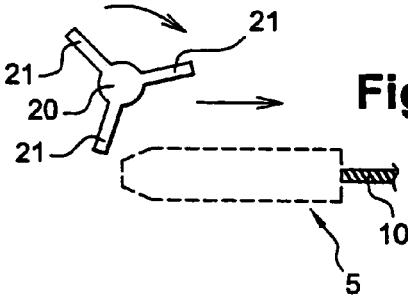
FIG. 18 is a schematic cross-sectional view of another embodiment of a method of manufacturing a brush.

According to some exemplary embodiments, it may be possible for the treatment member 20 to be rotated about an axis of rotation that is not parallel to the longitudinal axis of a brush 5, for example, about an axis of rotation that is substantially perpendicular to the longitudinal axis of the brush 5 (e.g., as shown in FIG. 18).

Figure 19:
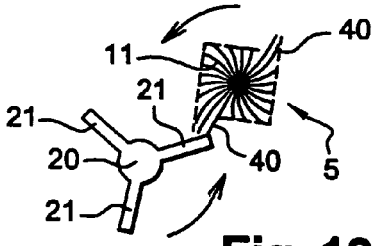
FIG. 19 is a schematic cross-sectional view of a further embodiment of a method of manufacturing a brush.
Figure 20:
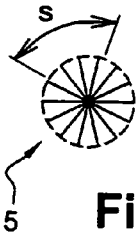
FIG. 20 is a schematic cross-sectional view of another embodiment of a method of manufacturing a brush.
Figure 21:
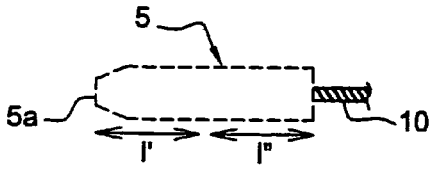
FIG. 21 is a schematic side view of a further embodiment of a method of manufacturing a brush.

According to some exemplary embodiments, the treatment member 20 may be used to treat only certain regions a brush 5, for example, only at locations substantially corresponding to peak zones 40, as shown in FIG. 19. According to such exemplary embodiments, it may be possible, for example, to keep the brush 5 substantially stationary and to position the treatment member 20 in such a manner that its blade(s) 21 come(s) into contact with substantially only the bristles 11 that correspond to peak zone(s) 40. In addition, it may be possible to treat only a predefined angular sector S of a brush 5, for example, as shown in FIG. 20. Furthermore, it may be possible to treat either only a proximal portion or only a distal portion (or both) of a brush 5 (e.g., with the proximal portion being treated, for example, over a length l' or the distal portion over a length l"), as shown in FIG. 21.

Figure 22:
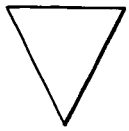
FIG. 22 is a schematic cross-section view of one embodiment of an envelope surface of a brush.
Figure 23:
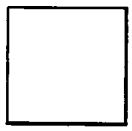
FIG. 23 is a schematic cross-section view of another embodiment of an envelope surface of a brush.
Figure 24:
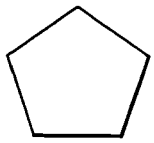
FIG. 24 is a schematic cross-section view of a further embodiment of an envelope surface of a brush.
Figure 25:
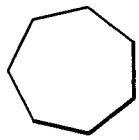
FIG. 25 is a schematic cross-section view of another embodiment of an envelope surface of a brush.

According to some exemplary embodiments, the brush 5 may also present an envelope surface having a cross-section defined by free ends of the bristles 11 that is substantially non-circular, for example, the cross-sections shown in FIGS. 22 though 32. Either before or after treatment via the treatment member 20, for example, the brush 5 may present an envelope surface cross-section that may be substantially polygonal in shape, for example, as shown in FIGS. 22 through 25. A brush 5 may have at least a portion of its length, which presents an envelope surface defining a cross-section that is substantially triangular (e.g., as shown in FIG. 22), substantially square (e.g., as shown in FIG. 23), substantially pentagonal (e.g., as shown in FIG. 24), substantially heptagonal (e.g., as shown in FIG. 25), or substantially octagonal (not shown).

Figure 26:
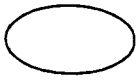
FIG. 26 is a schematic cross-section view of a further embodiment of an envelope surface of a brush.
Figure 27:
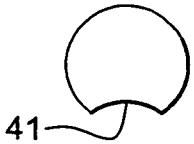
FIG. 27 is a schematic cross-section view of another embodiment of an envelope surface of a brush.
Figure 28:
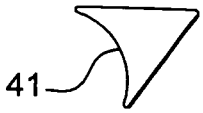
FIG. 28 is a schematic cross-section view of a further embodiment of an envelope surface of a brush.
Figure 29:
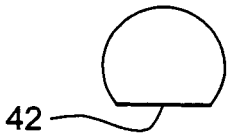
FIG. 29 is a schematic cross-section view of another embodiment of an envelope surface of a brush.

The brush 5 may be made in such a manner so as to present over at least a portion of its length, an envelope surface defining a cross-section that is oblong (e.g., as shown in FIG. 26), and/or that includes at least one indentation 41 over a fraction of its length (e.g., as shown in FIGS. 27 and 28). According to some exemplary embodiments, the indentation 41 can present a depth that varies along the length of the brush 5 and/or a width that varies along the length of the brush 5. According to some exemplary embodiments, the brush 5 may include, for example, at least one indentation 41 defining a depth that passes through a single extremum between the ends of the brush 5. According to some exemplary embodiments, the brush 5 may include at least one substantially planar facet 42 (e.g., as shown in FIG. 29).

Figure 30:
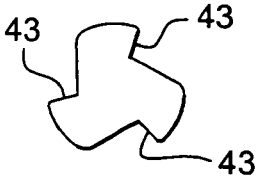
FIG. 30 is a schematic cross-section view of a further embodiment of an envelope surface of a brush.
Figure 31:
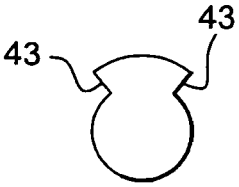
FIG. 31 is a schematic cross-section view of another embodiment of an envelope surface of a brush.
Figure 32:
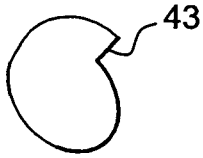
FIG. 32 is a schematic cross-section view of a further embodiment of an envelope surface of a brush.

According to some exemplary embodiments, the brush 5 may include one or more notches 43 (e.g., as shown in FIGS. 30 through 32). A brush 5, for example, may include three notches 43 (e.g., as shown in FIG. 30), two notches 43.(e.g., as shown in FIG. 31), or a single notch 43 (e.g., as shown in FIG. 32).

Figure 33:
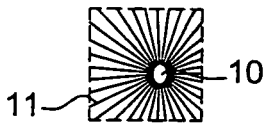
FIG. 33 is a schematic cross-section view of one embodiment of a brush.

According to some exemplary embodiments, the core 10 of the brush 5 may not be centered relative to the envelope surface defined by free ends of the bristles 11 of the brush 5 over at least a portion of the length of the brush 5 (e.g., as shown in FIG. 33).

Figure 34:
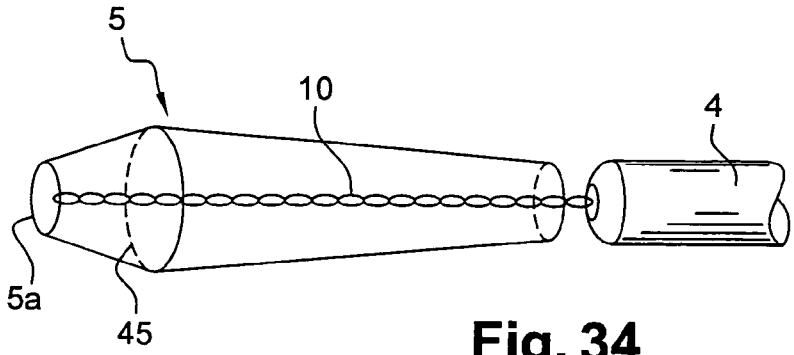
FIG. 34 is a schematic perspective view of one embodiment of a brush.

According to some exemplary embodiments, the cross-section of the brush 5 may vary along the length of the brush 5, and, for example, it may pass through an extremum (e.g., as shown in FIG. 34). FIG. 34 depicts an exemplary embodiment that includes an envelope surface of a brush 5 that defines, for example, two truncated cones that are united via their bases in the region 45 of greatest cross-sectional diameter of the brush 5.

Figure 35:
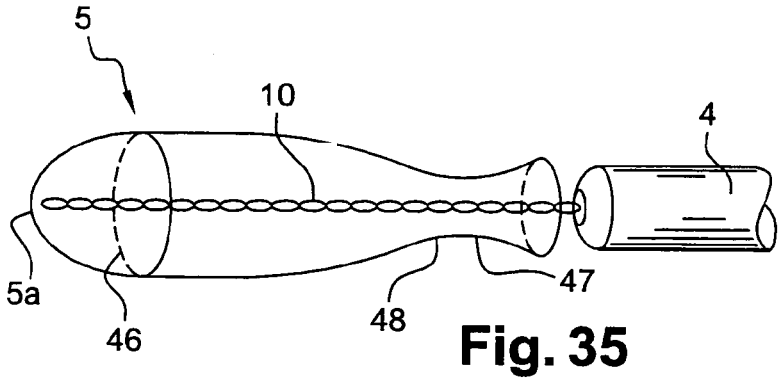
FIG. 35 is a schematic perspective view of another embodiment of a brush.
Figure 36:
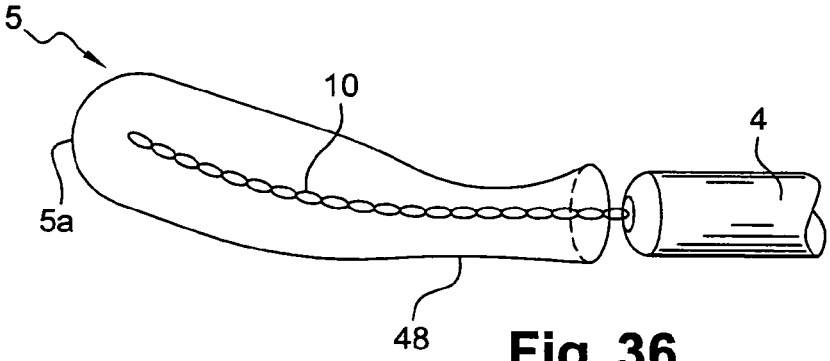
FIG. 36 is a schematic perspective view of the brush shown in FIG. 35 in another configuration.

According to some exemplary embodiments, the brush 5 may include a core 10 that is substantially non-rectilinear. For example, as shown in FIG. 35, when the core 10 is straightened to be made substantially rectilinear for observation purposes, the brush 5 may include a cross-section that passes through at least one extremum, which may be either a maximum or a minimum cross-section. In FIG. 35, for example, the exemplary brush 5 defines a cross-section passing through both a maximum cross-section 46 and through a minimum 47 cross-section. According to some exemplary embodiments, the core 10 may be curved so as to substantially straighten an edge 48 of the brush 5 (e.g., as shown in FIGS. 35 and 36).

Figure 37:
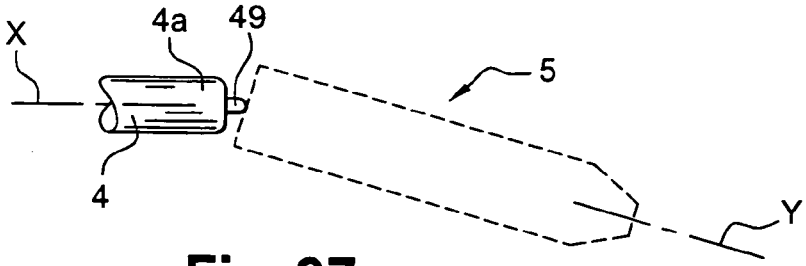
FIG. 37 is a schematic perspective view of a further embodiment of a brush.

In the exemplary embodiment shown in FIG. 37, the brush 5 may have a bend 49 in the vicinity of the distal end 4*a* of the stem 4, and the portion of the core 10 carrying the bristles 11 may be either rectilinear or curved.

According to some exemplary embodiments, the brush 5 may include bristles 11 defining a substantially solid cross-section. Alternatively, or in addition, the brush 5 may include bristles 11 defining a hollow cross-section.

Figure 38:
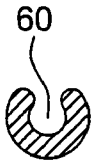
FIG. 38 is a schematic cross-section view of one embodiment of a bristle.
Figure 39:
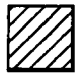
FIG. 39 is a schematic cross-section view of another embodiment of a bristle.
Figure 40:
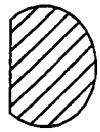
FIG. 40 is a schematic cross-section view of a further embodiment of a bristle.
Figure 41:
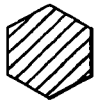
FIG. 41 is a schematic cross-section view of another embodiment of a bristle.
Figure 42:
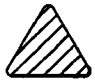
FIG. 42 is a schematic cross-section view of a further embodiment of a bristle.
Figure 43:
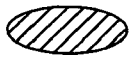
FIG. 43 is a schematic cross-section view of another embodiment of a bristle.
Figure 44:
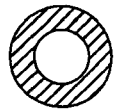
FIG. 44 is a schematic cross-section view of a further embodiment of a bristle.

FIGS. 38 though 44 depict some exemplary bristle cross-sections. The bristle shown in FIG. 38, for example, defines a generally kidney-shaped cross-section (e.g., defining a capillary groove 60). The bristle shown in FIG. 40, for example, defines a cross-section including a flat portion. At least some bristles 5 may define a substantially polygonal cross-section, for example, a square cross-section (e.g., as shown in FIG. 39), a hexagonal cross-section (e.g., as shown in FIG. 41), and a triangular cross-section (e.g., as shown in FIG. 42). At least some bristles 5 may define an oblong cross-section (e.g., as shown in FIG. 43). At least some bristles 5 may define a hollow cross-section, for example, a substantially circular tube-like cross-section (e.g., as shown in FIG. 44).

Figure 45:
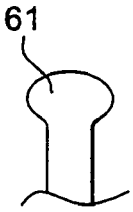
FIG. 45 is a schematic, partial perspective view of a portion of an embodiment of a bristle.
Figure 46:
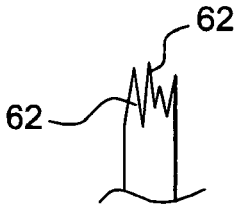
FIG. 46 is a schematic, partial perspective view of a portion of another embodiment of a bristle.

According to some exemplary embodiments, the bristles 11 may be subjected to treatment seeking to impart special properties to the free ends of the bristles 11 before and/or after contacting the bristles 11 with a treatment member 20, for example, in order to form a ball-shaped portion 61 (e.g., as shown in FIG. 45) and/or a forked portion 62 (e.g., as shown in FIG. 46). Forked portions 62 may be obtained, for example, by bringing the ends of the bristles into contact with an abrasive member.

Figure 47:
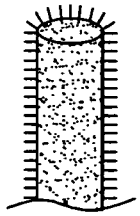
FIG. 47 is a schematic, partial perspective view of a portion of a further embodiment of a bristle.
Figure 48:
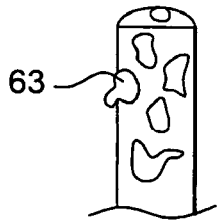
FIG. 48 is a schematic, partial perspective view of a portion of another embodiment of a bristle.

According to some exemplary embodiments, the bristles 11 may be flocked (e.g., as shown in FIG. 47) and/or they may carry a fill of particles 63 (e.g., as shown in FIG. 48). The particles 63 may include, for example, particles 63 of a compound configured to impart microrelief to the surface of the bristles 11, and/or for imparting magnetic and/or bacteriological and/or other properties (e.g., properties that encourage sliding).

The bristles 11 may be formed of synthetic and/or natural materials. For example, the bristles 11 may be formed of synthetic materials selected from polyethylenes, polyamides, and, for example, PA6, PA6/6, PA6/10, and/or PA6/12, PA11 (e.g., Rilsan®), a Hytrel®-Pebax® polymer, and/or other thermoplastic polymers. According to some embodiments, the bristles 11 may be stretchable (e.g., in a substantially permanent. manner).

Figure 49:
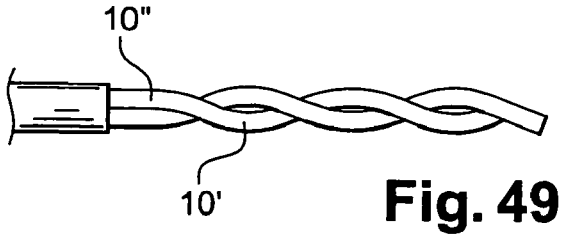
FIG. 49 is a schematic, partial side view of a portion of one embodiment of a brush.

The invention, however, is not limited to the exemplary embodiments described above. For example, the core 10 may include a dual core made up of two individual twisted cores 10' and 10", which may be twisted around each other (e.g., as shown in FIG. 49). Each individual core 10' or 10" shown in FIG. 49, for example, may itself comprise two twisted-together strands clamping onto bristles.

According to some exemplary embodiments, it may be possible to use metal strands optionally defining a substantially circular cross-section to form the core, and the strands may optionally be sheathed. For example, the diameter of the metal strands may range from about 0.3 millimeter to about 0.9 millimeter.

The characteristics of the various embodiments described above may be combined with one another.

Throughout the description, including the claims, the term "a" should be understood as being synonymous with "at least one" (i.e., relating to both the singular and the plural), unless otherwise specified to the contrary.

The device according to some exemplary embodiments of the invention may be used to apply cosmetic products and/or care products, such as make-up products, dermatological substances, and/or pharmaceutical compositions used for treating and/or changing the appearance and/or scent of keratinous fibers. However, in its broadest aspects, the present invention could be used to apply many other substances.

Furthermore, sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the-structure and methodology of the present invention. Thus, it should be understood that the invention is not limited to the examples discussed in the specification. Rather, the present invention is intended to cover modifications and variations.

What is claimed is:

1. A brush for applying a substance to keratinous fibers, the brush comprising:

a twisted core defining turns; and bristles extending from the twisted core, the bristles being clamped between the turns of the twisted core, wherein the bristles comprise at least two deformed bristles clamped between two adjacent turns of the twisted core, each of the at least two deformed bristles having a length, wherein at at least one point along the length each of the at least two deformed bristles comprises either removal of material at the at least one point, stretching of material at the at least one point, or flattening at the at least one point, and wherein each of the at least two deformed bristles extends outward from the at least one point in a non-radial manner with respect to the twisted core.

2. The brush of claim 1, wherein each of the at least two deformed bristles comprises at least two rectilinear portions joined by at least one bend.

3. The brush of claim 2, wherein the at least two rectilinear portions each define a cross-section and each of the cross-sections is substantially the same.

4. The brush of claim 1, wherein the at least two deformed bristles each define at least one bend that is located at substantially the same distance from the twisted core.

5. The brush of claim 1, wherein at least one of the at least two deformed bristles comprises a bristle having a substantially solid cross-section.

6. The brush of claim 1, wherein at least one of the at least two deformed bristles comprises at least one capillary groove.

7. The brush of claim 1, wherein at least 5% of the bristles comprise deformed bristles.

8. The brush of claim 1, wherein at least 30% of the bristles comprise deformed bristles.

9. The brush of claim 1, wherein at least 70% of the bristles comprise deformed bristles.

10. The brush of claim 1, wherein the brush comprises from about five bristles per turn of the twisted core to about 80 bristles per turn of the twisted core.

11. The brush of claim 1, wherein the brush comprises from about ten bristles per turn of the twisted core to about 50 bristles per turn of the twisted core.

12. The brush of claim 1, wherein at least some of the bristles have a diameter ranging from about $5/100$ millimeter to about $40/100$ millimeter.

13. The brush of claim 1, wherein at least some of the bristles comprise bristles formed from a synthetic material.

14. The brush of claim 1, wherein at least some of the bristles comprise bristles formed from a natural material.

15. The brush of claim 1, wherein at least some of the bristles have a destructured appearance.

16. The brush of claim 1, wherein at least some of the deformed bristles comprise one of removal of material and flattening of material extending only on one side of the deformed bristles.

17. The brush of claim 1, wherein the twisted core has a left-hand twist.

18. The brush of claim 1, wherein at least one of the deformed bristles comprises at least one deformed section at one point along its length and another deformed section at another point along its length.

19. The brush of claim 18, further comprising a bend at each deformed section of the at least one deformed bristle, each bend defining a differing angle.

20. The brush of claim 1, wherein, when the brush is viewed in a direction of observation perpendicular to a longitudinal axis of the brush, the brush comprises at least two bristles which cross each other.

21. The brush of claim 1, wherein the bristles comprise at least one hollow bristle.

22. The brush of claim 1, wherein at least one of the deformed bristles comprises removal of material at the at least one point.

23. The brush of claim 1, wherein at least one of the deformed bristles comprises stretching of material at the at least one point.

24. The brush of claim 1, wherein at least one of the deformed bristles comprises flattening at the at least one point.

25. A device for application of a substance to one of eyelashes and eyebrows, the device comprising:

the brush of claim 1; and a receptacle containing the substance to be applied.

26. The device of claim 25, wherein the substance is mascara.

27. The device of claim 24, wherein the receptacle is associated with a wiper member.

28. The device of claim 27, further comprising a stem comprising one end fixed to the brush and an opposite end comprising a handle member configured to close the receptacle.

29. A method of manufacturing a brush for applying a substance to keratinous fibers, the method comprising:

providing an initial brush comprising a twisted core defining turns, and bristles extending from the twisted core, the bristles being clamped between the turns of the twisted core; and relatively displacing at least one treatment member and the bristles of the initial brush with respect to one another such that the at least one treatment member strikes at least some of the bristles and changes, in a substantially permanent manner, the orientations of at least a portion of at least some of the bristles so as to form at least two deformed bristles clamped between two adjacent turns of the twisted core, each of the at least two deformed bristles having a length, wherein at at least one point along the length each of the at least two deformed bristles comprises either removal of material at the at least one point, stretching of material at the at least one point, or flattening at the at least one point, and wherein each of the at least two deformed bristles extends outward from the at least one point in a non-radial manner with respect to the twisted core.

30. The method of claim 29, wherein the treatment member is at ambient temperature.

31. The method of claim 29, wherein relatively displacing comprises at least rotating the initial brush about its axis.

32. The method of claim 29, wherein relatively displacing comprises at least rotating the treatment member.

33. The method of claim 29, wherein relatively displacing and relative positions of the brush and the at least one treatment member are selected such that the at least one treatment member contacts only a portion of the bristles during the method.

34. The method of claim 29, wherein the method forms bends in at least a portion of the bristles and the bends are spaced from the twisted core by a predefined distance.

35. The method of claim 29, wherein, prior to contact with the at least one treatment member, the initial brush comprises an envelope surface defining a cross-section that is substantially non-circular over at least a portion of the length of the envelope surface.

36. The method of claim 29, wherein the initial brush comprises bristles extending substantially around the twisted core and defining a circumference, and wherein only a portion of the bristles defining the circumference is contacted with the at least one treatment member.

37. The method of claim 29, wherein the initial brush defines a circumference and comprises bristles having differing lengths defining at least two regions of the circumference, wherein only a region defined by longer bristles is contacted with the at least one treatment member.

38. The method of claim 29, wherein only a portion of the length of the initial brush is contacted with the at least one treatment member.

39. The method of claim 29, wherein, prior to contact with the at least one treatment member, the bristles of the initial brush define a substantially constant cross-section.

40. The method of claim 29, wherein the twisted core supports from about five to about 80 bristles per turn of the twisted core.

41. The method of claim 29, wherein the twisted core supports from about ten to about 50 bristles per turn of the twisted core.

42. The method of claim 29, wherein, prior to contact with the at least one treatment member, the initial brush comprises bristles each having a free end, wherein the free ends follow a substantially helical distribution, and wherein, after contacting of the at least one treatment member with the bristles, the free ends do not present a substantially helical distribution.

43. The method of claim 29, wherein the brush comprises at least some bristles having a substantially non-circular cross-section.

44. The method of claim 29, wherein the brush comprises at least some bristles having at least one capillary groove.

45. The method of claim 29, wherein the method comprises manufacturing the initial brush.

46. A brush for applying a substance to keratinous fibers, wherein the brush is manufactured according to the method of claim 29.

47. A method of manufacturing a brush for applying a substance to keratinous fibers, the method comprising:

providing an initial brush comprising a core, and bristles extending from the core; and relatively displacing at least one treatment member and the bristles of the initial brush with respect to one another such that the at least one treatment member strikes at least some of the bristles and changes, in a substantially permanent manner, the orientations of at least a portion of at least some of the bristles so as to form at least two deformed bristles, each of the at least two deformed bristles having a length, wherein at at least one point along the length each of the at least two deformed bristles comprises either removal of material at the at least one point, stretching of material at the at least one point, or flattening at the at least one point, and wherein each of the at least two deformed bristles extends outward from the at least one point in a non-radial manner with respect to the core.

* * * * *